US010941017B2

(12) United States Patent
Qu et al.

(10) Patent No.: US 10,941,017 B2
(45) Date of Patent: Mar. 9, 2021

(54) CASH BOX AND BANKNOTE PROCESSING DEVICE USING SAME

(71) Applicant: Shandong New Beiyang Information Technology Co., Ltd., Shandong (CN)

(72) Inventors: Ping Qu, Shandong (CN); Zhenxing Zhao, Shandong (CN); Jiabo Xu, Shandong (CN); Chuntao Wang, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 0 days.

(21) Appl. No.: 16/493,727

(22) PCT Filed: Mar. 8, 2018

(86) PCT No.: PCT/CN2018/078395
§ 371 (c)(1),
(2) Date: Sep. 12, 2019

(87) PCT Pub. No.: WO2018/166395
PCT Pub. Date: Sep. 20, 2018

(65) Prior Publication Data

US 2020/0010301 A1 Jan. 9, 2020

(30) Foreign Application Priority Data

Mar. 13, 2017 (CN) ..... 201710147433.3

(51) Int. Cl.
*B65H 83/02* (2006.01)
*G07D 11/18* (2019.01)
(Continued)

(52) U.S. Cl.
CPC ..... *B65H 83/02* (2013.01); *B65H 29/52* (2013.01); *G07D 11/18* (2019.01); *G07D 11/225* (2019.01); *B65H 2701/1912* (2013.01)

(58) Field of Classification Search
CPC ..... B65H 83/02; B65H 29/52; G07D 11/18; G07D 11/225
See application file for complete search history.

(56) References Cited

U.S. PATENT DOCUMENTS 4,718,655 A * 1/1988 Okayama ..... B65H 3/06 271/3.08
5,553,840 A 9/1996 Arikawa
7,891,653 B2 * 2/2011 Park ..... G07D 11/14 271/3.14

FOREIGN PATENT DOCUMENTS

CN 101093590 A 12/2007
CN 101139051 A 3/2008
(Continued)

OTHER PUBLICATIONS

International Search Report issued in International Patent Application No. PCT/CN2018/078395, dated May 23, 2018, 5 pages.

*Primary Examiner* — Thomas A Morrison
(74) *Attorney, Agent, or Firm* — Wilmer Cutler Pickering Hale and Dorr LLP

(57) ABSTRACT

Disclosed are a cash box and a banknote processing device using the same. The cash box includes: a guiding plate, configured to guide a banknote to enter a banknote storage chamber; a pickup roller, configured to output the banknote; and a sensor, configured to detect a position of the guiding plate and a position of the pickup roller. When the guiding plate is in a banknote feeding position or the pickup roller is in a banknote pickup position, the sensor outputs a first signal. When the guiding plate deviates from the banknote feeding position and the pickup roller deviates from the banknote pickup position, the sensor outputs a second signal, wherein the first signal is different from the second signal.

12 Claims, 3 Drawing Sheets

(51) Int. Cl.
*G07D 11/225* (2019.01)
*B65H 29/52* (2006.01)

(56) References Cited

FOREIGN PATENT DOCUMENTS

| | | | |
|---|---|---|---|
| CN | 101465014 | A | 6/2009 |
| JP | H06-312872 | A | 11/1994 |

* cited by examiner

CASH BOX AND BANKNOTE PROCESSING DEVICE USING SAME

CROSS REFERENCE TO RELATED APPLICATIONS

This application is a U.S. National Phase Application of International Patent Application number PCT/CN2018/078395, filed on Mar. 8, 2018, and entitled "Cash Box and Banknote Processing Device Using Same," which claims priority to China Patent Application No. 201710147433.3, filed Mar. 13, 2017, entitled "Cash Box and Banknote Processing Device Using Same," each of which is incorporated herein by reference in its entirety.

TECHNICAL FIELD

The present disclosure relates to the field of automated machinery, for example, to a cash box and a banknote processing device using the same.

BACKGROUND

A deposit and withdrawal machine is usually provided with a cash box for storing and distributing banknotes. FIG. 1 is a structural schematic view of a cash box provided in the related art. As shown in FIG. 1, the cash box includes a housing 1', an opening 2', a feed roller 3', a gate roller 4', a pickup roller 5', a guiding plate 6', a transfer passage 7', a banknote storage chamber 8', and a pressing plate 9'. The opening 2' is disposed at an upper end of the housing. The banknote storage chamber 8' is provided inside the housing 1'. The feed roller 3' and the gate roller 4' are disposed at a side of the banknote storage chamber 8' adjacent to the opening 2'. The feed roller 3' and the gate roller 4' are oppositely disposed to form an entrance-and-exit for a banknote to enter and exit the banknote storage chamber 8'. The pickup roller 5' and the guiding plate 6' are disposed inside the banknote storage chamber 8' and are disposed downstream of the banknote entrance-and-exit along a direction of the banknote entering the banknote storage chamber 8'. The position of the pickup roller 5' relative to the entrance-and-exit is adjustable, and the pickup roller 5' has an initial position and a banknote pickup position. The position of the guiding plate 6' relative to the entrance-and-exit is adjustable, and the guiding plate 6' has a banknote feeding position and a lifted position. The transfer passage 7' is connected between the opening 2' and the entrance-and-exit. The pressing plate 9' is disposed in the banknote storage chamber 8'. When banknotes enter the banknote storage chamber 8', as shown in FIG. 1, the guiding plate 6' is located in its banknote feeding position, the pickup roller 5' is located in its initial position, the guiding plate 6' is operative to hide the pickup roller 5', and the banknotes are stacked on the pressing plate 9' under the guide of the guiding plate 6', where the banknotes do not contact with the pickup roller 5'. When banknotes in the cash box are output, the guiding plate 6' is located in its lifting position and the pickup roller 5' is located in its banknote pickup position. The guiding plate 6' rotates clockwise shown in FIG. 1 to expose the pickup roller 5', the pressing plate 9' lifts up the pickup roller 5', so that the banknotes are pressed onto the pickup roller 5' with a predetermined pressure. At this moment, the pickup roller 5' rotates to drive the banknotes contacting the pickup roller 5' to move towards the feed roller 3'. Then the feed roller 3' and the gate roller 4' would drive a single banknote to pass through the transfer passage 7' and then to be output by the opening 2'.

The above-mentioned cash box has a high purchase cost and occupies a large space, and is not beneficial to the miniaturization of the cash box.

SUMMARY

The present disclosure provides a cash box and a banknote processing device using the same to solve the technical problems of high purchase cost and large occupied space of the cash box in the related art.

The present disclosure provides a cash box which includes:

a guiding plate, configured to guide a banknote to enter a banknote storage chamber;

a pickup roller, configured to output the banknote; and a sensor, configured to detect a position of the guiding plate and a position of the pickup roller;

the sensor is configured to output a first signal when the guiding plate is in a banknote feeding position or to the pickup roller is in a banknote pickup position; and the sensor is configured to output a second signal when the guiding plate deviates from the banknote feeding position and the banknote trusting roller deviates from the banknote pickup position; where the first signal is different from the second signal.

In an embodiment, the guiding plate is connected with a first detecting member, and the pickup roller is connected with a second detecting member;

where the first detecting member is operative to trigger the sensor when the guiding plate is in the banknote feeding position; and the first detecting member is operative to be separated from the sensor when the guiding plate deviates from the banknote feeding position;

where the second detecting member is operative to trigger the sensor when the pickup roller is in the banknote pickup position; and the second detecting member is operative to be separated from the sensor when the pickup roller deviates from the banknote pickup position.

In an embodiment, the cash box further includes a pressing plate arranged in the banknote storage chamber and configured for supporting the banknote, and the pressing plate is configured to move in a direction of closing to the guiding plate to successively drive the guiding plate to deviate from the banknote feeding position and drive the pickup roller to reach the banknote pickup position.

In an embodiment, the sensor is disposed on a side of the guiding plate facing away from the pressing plate, and the first detecting member is located in downstream of the second detecting member in a direction pointing from the pressing plate to the guiding plate.

In an embodiment, the banknote storage chamber further includes an entrance-and-exit. An end of the guiding plate adjacent to the entrance-and-exit is pivotally connected with a housing and is operative to rotate around an axis of a pivoting shaft, and the first detecting member is operative to rotate synchronously along with the guiding plate.

In an embodiment, the cash box further includes a support frame configured to support the pickup roller. One end of the support frame is pivotally connected with a housing of the cash box and is operative to rotate around an axis of a pivoting shaft. The second detecting member is fixedly connected with the support frame, and the second detecting member and the pickup roller are both operative to rotate synchronously along with the support frame, where the pickup roller has the banknote pickup position and an initial position in a rotating process.

In an embodiment, the guiding plate and the support frame are coaxially pivotally connected with the housing and are both rotatable about the axis of the pivoting shaft, and the first detecting member is operative to rotate synchronously with the guiding plate.

In an embodiment, the cash box further includes an elastic component and a limiting member. One end of the elastic component is connected with the housing, and the other end of the elastic component is connected with the support frame. When at the initial position, the pickup roller is operative to abut against the limiting member, and the elastic component is configured to allow the pickup roller to have a permanent tendency of abutting against the limiting member.

In an embodiment, the pickup roller is slidably connected with a housing of the cash box, two ends of a core shaft of the pickup roller are slidably disposed in a guide groove of the housing and are movable along a length of the guide groove, where the pickup roller has an initial position and the banknote pickup position.

The present disclosure further provides a banknote processing device, which includes a deposit and withdrawal port mechanism, an identification mechanism, a temporary storage mechanism, a conveying mechanism, a recovery box, and any one of the cash boxes described above.

The deposit and withdrawal port mechanism is configured to feed banknotes put in by a user to the identification mechanism one by one or output banknotes verified by the identification mechanism one by one;

the identification mechanism is configured to detect and verify the banknotes;

the temporary storage mechanism is configured to temporarily store the banknotes;

the cash box is configured to store and distribute banknotes;

the recovery box is configured to store banknotes no longer circulated; and the conveying mechanism is configured to convey banknotes between any two of the deposit and withdrawal port mechanism, the identification mechanism, and the temporary storage mechanism, and between each mechanism and the cash box or the recovery box.

According to the present disclosure, the cash box and a banknote processing device using the same includes a guiding plate configured to guide banknotes to enter a banknote storage chamber, a pickup roller configured to output banknotes, and a sensor configured to detect a position of the guiding plate and a position of the pickup roller. When the guiding plate is in the banknote feeding position or the pickup roller is in the banknote pickup position, the sensor outputs a first signal. Otherwise when the guiding plate deviates from the banknote feeding position and the pickup roller deviates from the banknote pickup position, the sensor outputs a second signal, where the first signal is different from the second signal. Consequently, by detecting the change of the output signal of the sensor, it can be determined whether the pickup roller is located in the banknote pickup position and whether the guiding plate is located in the banknote feeding position. Compared with the cash boxes provided in the related art, the cash box provided by the present disclosure can detect the positions of the guiding plate and the pickup roller by using a single sensor, thus reducing the purchase cost of the cash box, simplifying the structure of the cash box, reducing the occupied space of the cash box, and facilitating the miniaturization of the cash box.

Figure 1:
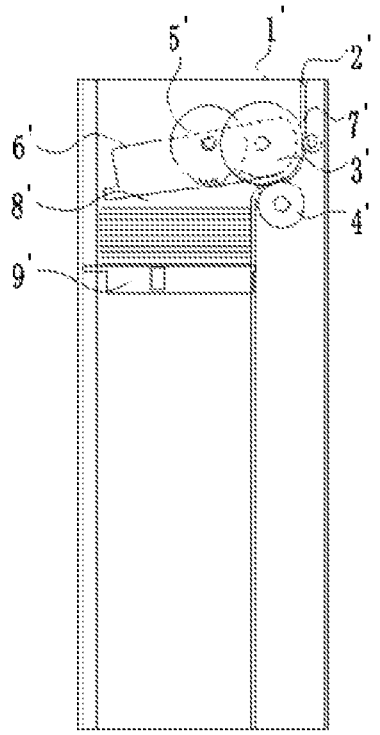
FIG. 1 is a structural schematic view of a cash box provided in the related art.

In the drawings: 1-Housing; 2-Stacking and separating component; 5-Detection component; 11-Opening; 12-Bankmote storage chamber; 13-Transfer passage; 20-Entrance-and-exit; 21-Feed roller; 211-Core shaft; 22-Gate roller; 23-Pickup roller; 24-Guiding plate; 25-Pressing plate; 51-Sensor; 52-First detecting member; 53-Second detecting member; 54-Support frame; 55-Limiting member; 56-Elastic component; 100-Deposit and withdrawal port mechanism; 200-Identification mechanism; 300-Temporary storage mechanism; 400-Cash box; 500-Conveying mechanism; 600-Recovery box.

DETAILED DESCRIPTION

In the description of the embodiment of the present disclosure, it should be understood that the orientational or positional relationships indicated by terms "center", "above", "below", "left", "right", "vertical", "horizontal", "inside", "outside" and the like are based on the orientational or positional relationships shown in the drawings, which are for the mere purpose of facilitating and simplifying the description of the present disclosure, and these relationships do not indicate or imply that the device or component referred to has a specific orientation and is constructed and operated in a specific orientation, and thus it is not to be construed as limiting the present disclosure. Moreover, terms like "first" and "second" are for the mere purpose of simplifying the description and are not to be construed as indicating or implying relative importance. For example, the terms "first position" and "second position" indicate two different positions.

In the description of the embodiments of the present disclosure, it should be noted that unless otherwise expressly specified and defined, terms like "mounted", "connected with each other", "connected" are to be construed in a broad sense, for example, as permanently connected, detachably connected or integratedly connected; mechanically connected or electrically connected; directly connected or indirectly connected via an intermediate medium; or internally connected of two elements.

With continued reference to FIG. 1, in order to ensure that a pickup roller 5' is in a reliable contact with banknotes as banknotes are output from a cash box, the pickup roller 5' is required to be at a banknote pickup position. Therefore, the cash box may further be provided with a first sensor (not shown in the figure) for detecting the banknote pickup position of the pickup roller 5'. Furthermore, to ensure that the banknotes are reliably stacked as they enter the cash box under the guide of a guiding plate 6', the guiding plate 6' is required to be at a banknote feeding position, and therefore a second sensor (not shown in the figure) for detecting the banknote feeding position of the guiding plate 6' may further be provided.

Such cash box employs two sensors to separately detect the banknote feeding position of the guiding plate 6' and the banknote pickup position of the pickup roller 5', which however would increase the purchasing cost of the cash box, enlarge the occupied space, which therefore is not beneficial to the miniaturization of the cash box.

Figure 2:
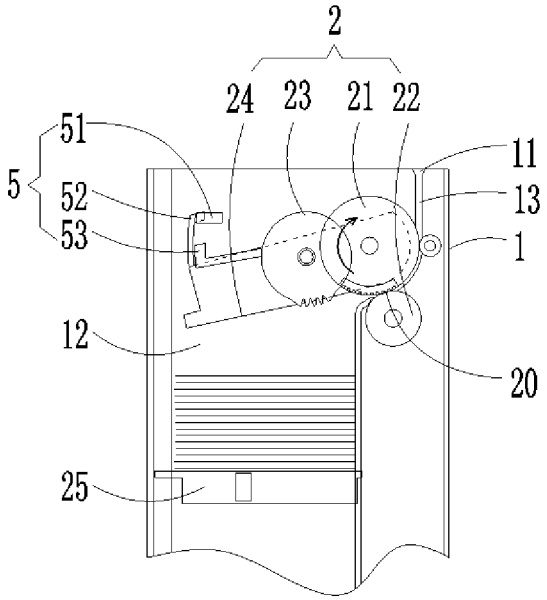
FIG. 2 is a first schematic view of a partial structure of a cash box according to an embodiment of the present disclosure.

FIG. 2, is a schematic diagram of a cash box according to an embodiment of the present disclosure. As shown in FIG. 2, a cash box is provided which includes: a guiding plate 24 configured to guide banknotes to enter a banknote storage chamber 12; a pickup roller 23 configured to output banknotes; and a sensor 51, configured to detect a position of the guiding plate 24 and a position of the pickup roller 23. When the guiding plate 24 is in a banknote feeding position or the pickup roller 23 is in a banknote pickup position, the sensor 51 outputs a first signal. When the guiding plate 24 deviates from the banknote feeding position and the pickup roller 23 deviates from the banknote pickup position, the sensor 51 outputs a second signal, where the first signal is different from the second signal.

There is one of the sensor 51 described above, and the guiding plate 24 and the pickup roller 23 share the same sensor 51 for purposes of detecting their positions.

Optionally, the guiding plate 24 is connected with a first detecting member 52, and the pickup roller 23 is connected with a second detecting member 53. When at the banknote feeding position, the guiding plate 24 drives the first detecting member 52 to trigger the sensor 51. When deviating from the banknote feeding position, the guiding plate 24 drives the first detecting member 52 to separate from the sensor 51. When at the banknote pickup position, the pickup roller 23 drives the second detecting member 53 to trigger the sensor 51. When deviating from the banknote pickup position, the pickup roller 23 drives the second detecting member 53 to separate from the sensor 51.

As shown in FIG. 2, the cash box includes a housing 1, a stacking and separating component 2, and a detection component 5.

The housing 1 has a rectangular parallelepiped shape, and a surface of the housing 1 is provided with an opening 11. The interior of the housing 1 is provided with the banknote storage chamber 12 and a transfer passage 13. The banknote storage chamber 12 is configured to stack and store banknotes, and the transfer passage 13 is connected between the opening 11 and the banknote storage chamber 12. In the present embodiment, the opening 11 is disposed on an upper surface of the housing 1, and the banknotes are stacked in a vertical direction inside the banknote storage chamber 12. In other embodiments, the banknotes can be stacked in a horizontal direction inside the banknote storage chamber 12, the opening 11 may be disposed on a side of the housing 1, and a conveying roller or a conveying belt for driving the banknotes to move along the transfer passage 13 can be further provided in the transfer passage 13.

The Stacking and separating component 2 is disposed between the banknote storage chamber 12 and the transfer passage 13 and is configured to drive the banknotes to move between the banknote storage chamber 12 and the transfer passage 13. The Stacking and separating component 2 includes a feed roller 21, a gate roller 22, and the pickup roller 23, the guiding plate 24, an elastic member, and a motor (not shown in the figure). The detection component 5 includes the sensor 51, the first detecting member 52, and the second detecting member 53.

The cash box may further includes a pressing plate 25 configured to support banknotes and a banknote pressing drive member configured to drive the pressing plate 25 to move. The pressing plate 25 is disposed in the banknote storage chamber 12 and moves along a direction of closing to the guiding plate 24 to successively drive the guiding plate 24 to deviate from the banknote feeding position and drive the pickup roller 23 to reach the banknote pickup position. That is, when the pressing plate 25 moves along the direction of closing to the guiding plate 24, the pressing plate 25 drives the guiding plate 24 to deviate from the banknote feeding position, and then drives the pickup roller 23 to reach the banknote pickup position.

The sensor 51 may be fixedly installed on an inner wall of the housing 1, and the sensor 51 may be a photoelectric sensor. The first detecting member 52 is disposed on the guiding plate 24, and when the guiding plate 24 rotates, the first detecting member 52 rotates along with the guiding plate 24. The first detecting member 52 is operative to match up with the sensor 51 when the guiding plate 24 is in the banknote feeding position. The first detecting member 52 is operative to be separated from the sensor 51 when the guiding plate 24 deviates from the banknote feeding position. The second detecting member 53 is fixedly connected with the pickup roller 23. When the pickup roller 23 moves relative to the housing 1, the second detecting member 53 moves along with the pickup roller 23. When the pickup roller 23 is located in the initial position, the second detecting member 53 is separated from the sensor 51. At this moment, the pickup roller 23 does not contact with the banknote. When the pickup roller 23 is located in the banknote pickup position, the second detecting member 53 matches up with the sensor 51. At this moment, the pickup roller 23 may drive the banknote contacting with the pickup roller 23 to move.

The sensor 51 is implemented as a photoelectric sensor, when the guiding plate 24 is in a banknote feeding position or the pickup roller 23 is in a banknote pickup position, an optical path of the photoelectric sensor is cut off so that the photoelectric sensor outputs the first signal. When the guiding plate 24 deviates from the banknote feeding position and the pickup roller 23 deviates from the banknote pickup position, the optical path of the photoelectric sensor is connected so that the photoelectric sensor outputs the second signal.

Optionally, the sensor 51 is disposed on a side of the guiding plate 24 away from the pressing plate 25, and the first detecting member 52 is located in downstream of the second detecting member 53 in a direction of the pressing plate 25 closing to the guiding plate 24. In other embodiments provided by the present disclosure, the sensor 51 may be further disposed on a side of the guiding plate 24 facing the pressing plate 25, and the first detecting member 52 is located in upstream of the second detecting member 53 in a direction of the pressing plate 25 closing to the guiding plate 24.

The feed roller 21 and the gate roller 22 are located in an end of the banknote storage chamber 12 adjacent to the transfer passage 13, and are oppositely disposed. An entrance-and-exit 20 for the banknotes to enter and exit the banknote storage chamber 12 is formed between the feed roller 21 and the gate roller 22, and is connected with the transfer passage 13. The pickup roller 23 is disposed inside the banknote storage chamber 12, and is located upstream of the feed roller 21 along the direction of the banknote output in the banknote storage chamber 12. The pickup roller 23 is movably connected with the housing 1 and has an initial position and a banknote pickup position. The guiding plate 24 is disposed in the banknote storage chamber 12, an end of the guiding plate 24 adjacent to the entrance-and-exit 20 is pivotally connected with the housing 1, the guiding plate 24 is operative to rotate around the axis of the pivoting shaft, the first detecting member 52 is operative to rotate synchronously along with the guiding plate 24, and the guiding plate 24 has the banknote feeding position and the lifting position deviating from the banknote feeding position.

The pressing plate 25 is further configured to press the banknote towards pickup roller 23 as the cash box outputs the banknote. The banknote pressing driving member is in a transmission connection with the pressing plate 25, and the banknote pressing driving member is configured to drive the pressing plate 25 to perform a reciprocating motion along the banknote stacking direction, to make the pressing plate 25 press the banknote to the pickup roller 23, or make a distance between the pressing plate 25 and the guiding plate 24 to form a space for stacking the banknotes.

The motor is configured to drive the feed roller 21, the gate roller 22 and the pickup roller 23 to rotate, and to drive the feed roller 21 and the gate roller 22 to rotate along the banknote feeding direction when an output shaft of the motor rotates along the first direction, thereby driving banknotes in the transfer passage 13 to enter the banknote storage chamber 12 through the entrance-and-exit 20. When rotating along the second direction opposite to the first direction, the output shaft of the motor is operative to drive the feed roller 21 and the pickup roller 23 to rotate along the banknote output direction. The pickup roller 23 is operative to drive the banknotes contacting with the pickup roller 23 to move towards the feed roller 21, and the feed roller 21 and the gate roller 22 drive a single banknote to enter the transfer passage 13 through the entrance-and-exit 20. The banknote feeding direction is a direction where the banknotes enter the banknote storage chamber 12 through the entrance-and-exit 20, and the banknote output direction is a direction where the banknotes enter the transfer passage 13 through the entrance-and-exit 20.

In the present embodiment, the second detecting member 53 is fixedly connected with a support frame 54 for supporting the pickup roller 23. The support frame 54 is configured to support the pickup roller 23, an end of the support frame 54 is pivotally connected with the housing 1, and the support frame 54 is operative to rotate around the axis of the pivoting shaft.

The second detecting member 53 is fixedly connected with the support frame 54, the second detecting member 53 and the pickup roller 23 rotate synchronously with the support frame 54, and the pickup roller 23 has the banknote pickup position and the initial position in the rotating process. The sensor 51 outputs the first signal when either of the first detecting member 52 and the second detecting member 53 matches up with the sensor 51, and the sensor 51 outputs the second signal when neither the first detecting member 52 nor the second detecting member 53 matches up with the sensor 51.

The cash box may further include a limiting member 55 matching up with the pickup roller 23 and an elastic component 56. An end of the elastic component 56 is connected with the housing 1, and the other end of the elastic component 56 is connected with the support frame 54. When at the initial position, the pickup roller 23 abuts against the limiting member 55, and the elastic component 56 allows the pickup roller 23 to have a permanent tendency of abutting against the limiting member 55.

When the guiding plate 24 is located in the banknote feeding position and the pickup roller 23 is located in the initial position, in the direction which the banknotes enter the banknote storage chamber 12, the guiding plate 24 is inclined and the guiding plate 24 hides the pickup roller 23. The guiding plate 24 guides the banknote input from the entrance-and-exit 20 to be stacked on the pressing plate 25 without contacting with the pickup roller 23. When the guiding plate 24 is located in the lifting position and the pickup roller 23 is located in the banknote pickup position, the guiding plate 24 is rotated about the pivoting shaft to a position where the pickup roller 23 is exposed, and the banknote is clamped between the pickup roller 23 and the pressing plate 25 in a predetermined pressure, at this moment, the banknote contacting with the pickup roller 23 can be driven to move toward the feed roller 21 if the pickup roller 23 is rotated in the banknote output direction.

In the present embodiment, since the guiding plate 24 is above the banknote storage chamber 12, the guiding plate 24 is located in the banknote feeding position via its own gravity without external force. And in other embodiments, when the guiding plate 24 is located in a side of the banknote storage chamber 12, the guiding plate 24 may be disposed at the banknote feeding position by providing the elastic component.

Optionally, the guiding plate 24 and the support frame 54 are coaxially and pivotally connected with the housing 1 and can both rotate around the axis of the pivoting shaft. And the first detecting member 52 rotates synchronously with the guiding plate 24, and the second detecting member 53 rotates synchronously with the support frame 54.

In the present embodiment, the pickup roller 23 is supported by the support frame 54. The support frame 54 is sleeved on a core shaft 211 of the feed roller 21, and both ends of the core shaft 211 of the feed roller 21 are supported by the housing 1. And the pickup roller 23 is operative to rotate around the core shaft 211 of the feed roller 21 along with the support frame 54 and has the initial position and the banknote pickup position. In the present embodiment, due to a center of rotation of the pickup roller 23 is configured to be the core shaft 211 of the feed roller 21, i.e. a center distance between the pickup roller 23 and the feed roller 21 is not changed, a transmission gear set can be provided between the feed roller 21 and the pickup roller 23, and the motor can indirectly drive the pickup roller 23 to rotate by driving the feed roller 21 to rotate and transmitting the rotation via the transmission gear set, thereby simplifying the transmission structure between the motor and the pickup roller 23.

In the present embodiment, an end of the guiding plate 24 is sleeved on the core shaft of the feed roller 21, and the guiding plate 24 can rotate around the core shaft of the feed roller 21 and has the banknote feeding position and the lifting position. In the present embodiment, because the guiding plate 24 is directly sleeved on the core shaft of the feed roller 21, there is no need to provide a separate rotating shaft to pivotally connect the guiding plate 24 to the housing 1, thereby reducing the number of components.

The same pivoting shaft of the guiding plate 24 and the support frame 54 may be a core shaft of the feed roller 21.

In other embodiments, the pickup roller 23 is slidably connected with the housing 1, for example, two ends of the core shaft of the pickup roller 23 may be inserted into a guide groove provided in an inner wall of the housing 1, the pickup roller 23 is operative to move along a length of the guide groove, and the pickup roller 23 has the initial position and the banknote pickup position and is stayed at the initial position under the action of the elastic component.

When the guiding plate 24 is located in the banknote feeding position and the pickup roller 23 is located in the initial position, the guiding plate 24 is inclined toward the banknote storage chamber 12 in the direction which the banknotes enter the banknote storage chamber 12, and the guiding plate 24 hides the pickup roller 23. The guiding plate 24 guides the banknote input from the entrance-and-exit 20 to be stacked onto the pressing plate 25 without the banknote contacting with the pickup roller 23. When the guiding plate 24 is located in the lifting position and the pickup roller 23 is located in the banknote pickup position, the guiding plate 24 is rotated about the pivoting shaft to a position where the pickup roller 23 is exposed, and the banknote is clamped between the pickup roller 23 and the pressing plate 25 with a predetermined pressure. At this moment, the banknote contacting with the pickup roller 23 may be driven to move toward the feed roller 21 if the pickup roller 23 is rotated in the banknote output direction.

In the present embodiment, the inner wall of the housing 1 may have a limiting member, and since the guiding plate 24 is above the banknote storage chamber 12, a free end of the guiding plate 24 is lapped on the limiting member under its own gravity and located in the banknote feeding position without external force. In other embodiments, when the guiding plate 24 is located in the side of the banknote storage chamber 12, the guiding plate 24 may be disposed at the banknote feeding position by providing an elastic component.

In the present embodiment, the pickup roller 23 is supported by the support frame 54 sleeved on a core shaft 211 of the feed roller 21, and both ends of the core shaft 211 of the feed roller 21 are supported by the housing 1. And the pickup roller 23 is operative to rotate around the core shaft 211 of the feed roller 21 along with the support frame 54 and has the initial position and the banknote pickup position. In the present embodiment, because a center of rotation of the pickup roller 23 is configured to be the core shaft 211 of the feed roller 21, i.e. a center distance between the pickup roller 23 and the feed roller 21 is not changed, a transmission gear set can be provided between the feed roller 21 and the pickup roller 23, and the motor can indirectly drive the pickup roller 23 to rotate by driving the feed roller 21 to rotate and transmitting the rotation via the transmission gear set, thereby simplifying the transmission structure between the motor and the pickup roller 23.

In the present embodiment, an end of the guiding plate 24 is sleeved on the core shaft of the feed roller 21, and the guiding plate 24 may rotate around the core shaft of the feed roller 21 and has the banknote feeding position and the lifting position. In the present embodiment, because the guiding plate 24 is directly sleeved on the core shaft of the feed roller 21, there is no need to provide a separate rotating shaft to pivotally connect the guiding plate 24 to the housing 1, thereby reducing the number of the components.

In other embodiments, the pickup roller 23 is slidably connected with the housing 1, for example, two ends of the core shaft of the pickup roller 23 can be slidably connected with a guide groove provided on an inner wall of the housing 1, can move along a length of the guide groove, and the pickup roller 23 have the initial position and the banknote pickup position, and the pickup roller 23 is stayed at the initial position under the action of the elastic component.

The working process of the cash box provided by the embodiment of the present disclosure is described below.

Figure 3:
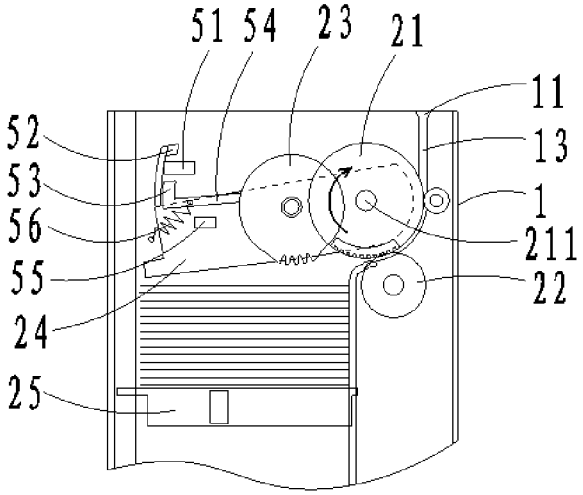
FIG. 3 is a second schematic view of a partial structure of the cash box according to an embodiment of the present disclosure.
Figure 4:
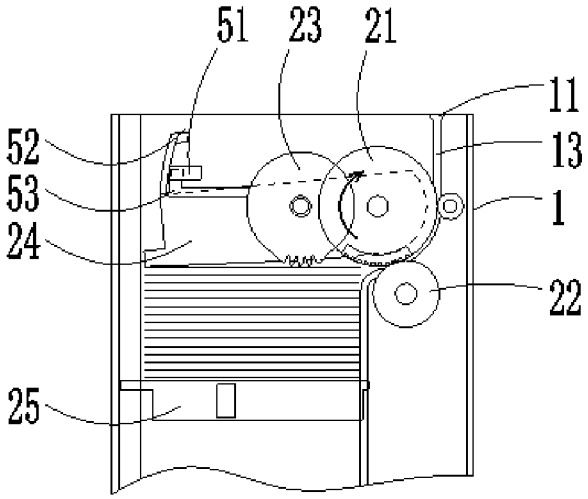
FIG. 4 is a third schematic view of a partial structure of the cash box according to an embodiment of the present disclosure.

When the cash box is used for outputting banknotes, the banknote pressing driving member is controlled to drive the pressing plate 25 to move a set distance away from the pickup roller 23, so that the first detecting member 52 mounted on the guiding plate 24 matches up with the sensor 51, the sensor 51 is triggered to output the first signal. Then, the banknote pressing driving member is controlled to drive the pressing plate 25 to move towards the pickup roller 23, the pressing plate 25 pushes the guiding plate 24 and the pickup roller 23 to rotate clockwise as shown in FIG. 2. And during the movement of the pressing plate 25, the first detecting member 52 on the guiding plate 24 is separated from the sensor 51, and the second detecting member 53 does not match up with the sensor 51, as shown in FIG. 3, so that the sensor 51 outputs the second signal. As the pressing plate 25 continues to move, as shown in FIG. 4, when the second detecting member 53 is matches up with the sensor 51, the sensor 51 is triggered to output the first signal again, indicating that the pickup roller 23 moves to the banknote pickup position, that is, in the process that the pressing plate 25 moves in the direction away from the pickup roller 23 and then moves in the direction of closing to the pickup roller 23, by driving the guiding plate 24 and the pickup roller 23 to move, the first detecting member 52 and the second detecting member 53 successively trigger the sensor 51, and the sensor 51 successively outputs a first signal, the second signal, and a first signal. When the sensor 51 outputs the first signal for the second time, the pickup roller 23 is located in the banknote pickup position, and at this moment, the pressing plate 25 is controlled to stop moving towards the pickup roller 23, then the motor controlling the Stacking and separating component 2 drives the pickup roller 23 and the feed roller 21 to rotate along the banknote output direction, so that banknotes are output.

When the cash box is used for storing banknotes, the banknote pressing driving member is controlled to drive the pressing plate 25 to move a set distance away from the pickup roller 23, so that the first detecting member 52 on the guiding plate 24 matches up with the sensor 51, the sensor 51 is triggered to output the first signal. Then, the banknote pressing driving member is controlled to drive the pressing plate 25 to move towards the pickup roller 23, and the guiding plate 24 and the pickup roller 23 are pushed to rotate clockwise as shown in FIG. 2. And the first detecting member 52 is separated from the sensor 51, and the second detecting member 53 does not match up with the sensor 51, therefore, the sensor 51 outputs the second signal. As the pressing plate 25 continues to move, as shown in FIG. 4, when the second detecting member 53 connected with the pickup roller 23 matches up with the sensor 51, the sensor 51 is triggered to outputs the first signal again, accordingly, the banknote pressing driving member is controlled to drive the pressing plate 25 to move in a direction away from the pickup roller 23 until the sensor 51 outputs the first signal again, at this moment, it indicates that the guiding plate 24 is located in the banknote feeding position and the pickup roller 23 is in the initial position, i.e., firstly, the pressing plate 25 is driven to move a set distance in a direction away from the pickup roller 23, then, to move in a direction of closing to the pickup roller 23 to make the sensor 51 successively output the first signal, the second signal and the first signal, then the pressing plate 25 is driven to move in the direction away from the pickup roller 23 again to make the sensor 51 continues to output the second signal and the first signal, when the sensor 51 outputs the first signal for the third time, it is determined that the guiding plate 24 is located at the banknote feeding position, and finally, the motor is controlled to drive the feed roller 21 and the gate roller 22 to rotate along the banknote feeding direction, and banknotes in the transfer passage 13 are driven to enter the banknote storage chamber 12 to be stacked and stored.

The cash box of the present disclosure includes: the guiding plate 24, configured to guide banknotes to enter the banknote storage chamber 12; a pickup roller 23, configured to output banknotes; and a sensor 51, configured to detect the position of the guiding plate 24 and the position of the pickup roller 23. When the guiding plate 24 is located in the banknote feeding position or the pickup roller 23 is located in the banknote pickup position, the sensor 51 outputs a first signal; and when the guiding plate 24 deviates from the banknote feeding position and the pickup roller 23 deviates from the banknote pickup position, the sensor 51 outputs a second signal, the first signal is different from the second signal. Therefore, by detecting the change of the output signal of the sensor, it can be determined whether the pickup roller 23 is located in the banknote pickup position and whether the guiding plate 24 is located in the banknote feeding position. Compared with the cash boxes provided in the related art, the cash box provided by the embodiment of the present disclosure can use only one sensor 51 to detect the positions of the guiding plate 24 and the pickup roller 23, thus reducing the purchase cost of the cash box, simplifying the structure of the cash box, reducing the occupied space of the cash box, and facilitating the miniaturization of the cash box.

Figure 5:
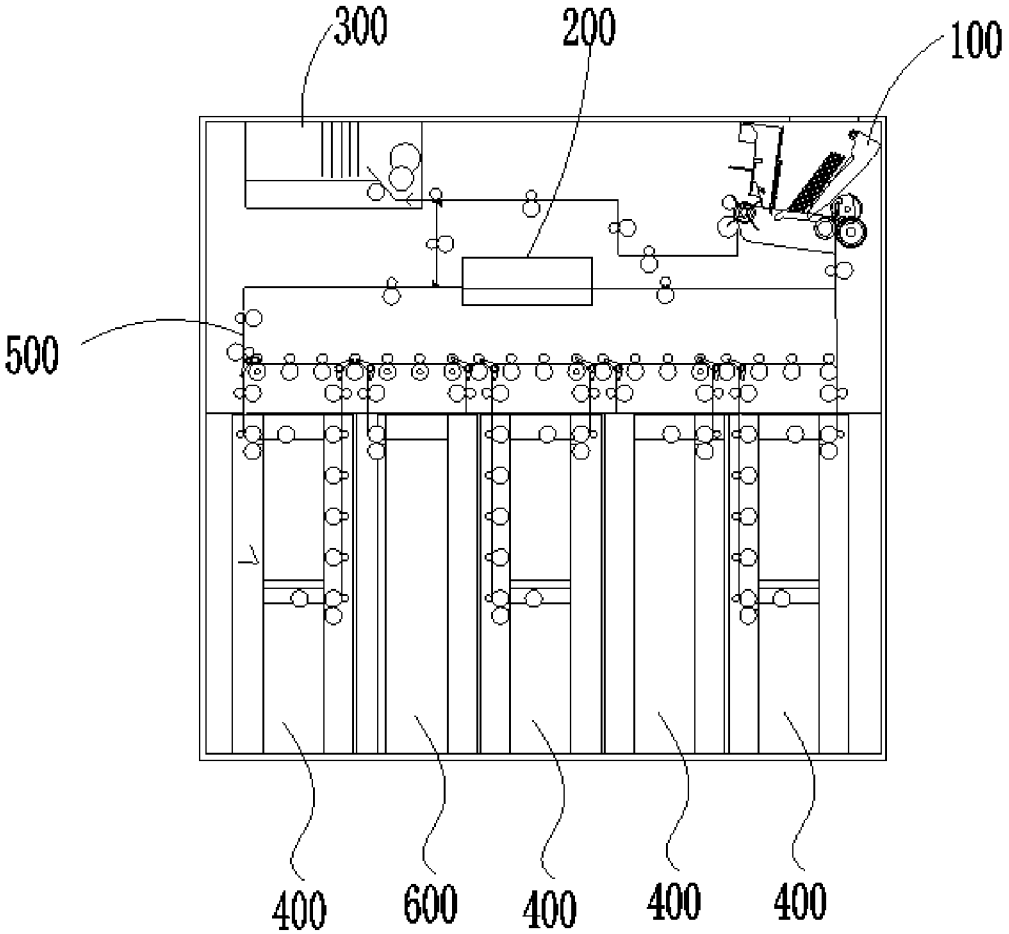
FIG. 5 is a structural schematic view of a banknote processing device in the cash box according to an embodiment of the present disclosure.

FIG. 5 is a structural schematic diagram view of banknotes in the cash box processing device according to an embodiment of the present disclosure. As shown in FIG. 5, in the present embodiment, the banknote processing apparatus is a deposit and withdrawal machine including a depositing and dispensing opening mechanism 100, an identification mechanism 200, a temporary storage mechanism 300, a cash box 400, a delivery mechanism 500, and a recovery box 600. The depositing and dispensing opening mechanism 100 is configured to feed banknotes put by a user to the identification mechanism 200 one by one or to output banknotes verified by the identification mechanism 200 one by one for the user to take away. The identification mechanism 200 is configured to perform banknote detection and identification, the temporary storage mechanism 300 is configured to temporarily store banknotes, the cash box 400 is configured to store and distribute the banknotes, and the structural form and the working principle of the cash box 400 are the same as that of the cash box provided in the above-mentioned embodiment of the present disclosure, and is not to be detailed herein again. The recovery box 600 is configured to store banknotes that are no longer circulated, and the conveying mechanism 500 is configured to convey banknotes between any two of the deposit and withdrawal port mechanism 100, the identification mechanism 200, and the temporary storage mechanism 300, and between each mechanism and the cash box 400 or the recovery box 600.

By using the cash box provided by the embodiments of the present disclosure, the banknote processing device in the present embodiment reduces the purchase cost of the banknote processing and it is also beneficial to the miniaturization of the banknote processing.

INDUSTRIAL APPLICABILITY

The cash box and the banknote processing device using the same provided by the present disclosure can detect the positions of the guiding plate and the pickup roller by using a single sensor, thus reducing the purchase cost of the cash box, simplifying the structure of the cash box, reducing the occupied space of the cash box, and facilitating the miniaturization of the cash box.

What is claimed is:

1. A cash box, comprising:

a guiding plate, configured to guide a banknote to enter a banknote storage chamber;

a pickup roller, configured to output a banknote; and one sensor, configured to detect a position of the guiding plate and a position of the pickup roller;

wherein the one sensor is configured to output a first signal when the guiding plate is in a banknote feeding position or the pickup roller is in a banknote pickup position;

wherein the one sensor is configured to output a second signal in response to the guiding plate deviating from the banknote feeding position and the pickup roller deviating from the banknote pickup position; wherein the first signal is different from the second signal;

wherein the guiding plate is connected with a first detecting member, and the pickup roller is connected with a second detecting member;

wherein the first detecting member is operative to trigger the one sensor when the guiding plate is in the banknote feeding position; and the first detecting member is operative to be separated from the one sensor in response to the guiding plate deviating from the banknote feeding position;

wherein the second detecting member is operative to trigger the one sensor when the pickup roller is in the banknote pickup position; and the second detecting member is operative to be separated from the one sensor in response to the pickup roller deviating from the banknote pickup position;

wherein the cash box further comprises a pressing plate arranged in the banknote storage chamber and configured for supporting the banknote, wherein the pressing plate is configured to move in a direction of closing to the guiding plate to successively drive the guiding plate to deviate from the banknote feeding position and drive the pickup roller to reach the banknote pickup position; and wherein the one sensor is disposed on a side of the guiding plate far away from the pressing plate, and the first detecting member is located downstream of the second detecting member in a direction of the pressing plate nearing the guiding plate.

2. The cash box of claim 1, wherein the banknote storage chamber further comprises an entrance-and-exit; an end of the guiding plate adjacent to the entrance-and-exit is pivotally connected with a housing of the cash box and is operative to rotate around an axis of a pivoting shaft, and the first detecting member is operative to rotate synchronously along with the guiding plate.

3. The cash box of claim 1, further comprising a support frame configured to support the pickup roller, wherein one end of the support frame is pivotally connected with a housing of the cash box and is operative to rotate around an axis of a pivoting shaft; the second detecting member is fixedly connected with the support frame, wherein the second detecting member and the pickup roller are both operative to rotate synchronously along with the support frame, the pickup roller having the banknote pickup position and an initial position in a rotating process.

4. The cash box of claim 3, wherein the guiding plate and the support frame are coaxially pivotally connected with the housing and are both rotatable about the axis of the pivoting shaft, and the first detecting member is operative to rotate synchronously with the guiding plate.

5. The cash box of claim 3, further comprising an elastic component and a limiting member, wherein one end of the elastic component is connected with the housing, and another end of the elastic component is connected with the support frame; when at the initial position, the pickup roller is operative to abut against the limiting member, and the elastic component is configured to allow the pickup roller to have a permanent tendency of abutting against the limiting member.

6. The cash box of claim 1, wherein the pickup roller is slidably connected with a housing of the cash box, two ends of a core shaft of the pickup roller are slidably disposed in a guide groove of the housing and are movable along a length of the guide groove, the pickup roller having an initial position and the banknote pickup position.

7. A banknote processing device, comprising a deposit and withdrawal port mechanism, an identification mechanism, a temporary storage mechanism, a conveying mechanism, a recovery box, and a cash box, wherein:

the deposit and withdrawal port mechanism is configured to feed banknotes put by a user to the identification mechanism one by one or output banknotes verified by the identification mechanism one by one;

the identification mechanism is configured to detect and verify the banknotes;

the temporary storage mechanism is configured to temporarily store the banknotes;

the cash box is configured to store and distribute banknotes;

the recovery box is configured to store banknotes no longer circulated; and the conveying mechanism is disposed between any two of the following mechanisms: the deposit and withdrawal port mechanism, the identification mechanism, and the temporary storage mechanism, and is configured to convey banknotes between each mechanism and the cash box or the recovery box; wherein the cash box comprises:

a guiding plate, configured to guide a banknote to enter a banknote storage chamber;

a pickup roller, configured to output a banknote; and one sensor, configured to detect a position of the guiding plate and a position of the pickup roller; wherein the one sensor is configured to output a first signal when the guiding plate is in a banknote feeding position or the pickup roller is in a banknote pickup position; and the one sensor is configured to output a second signal in response to the guiding plate deviating from the banknote feeding position and the pickup roller deviating from the banknote pickup position; wherein the first signal is different from the second signal;

wherein the guiding plate is connected with a first detecting member, and the pickup roller is connected with a second detecting member;

wherein the first detecting member is operative to trigger the one sensor when the guiding plate is in the banknote feeding position, and is operative to be separated from the one sensor in response to the guiding plate deviating from the banknote feeding position;

wherein the second detecting member is operative to trigger the one sensor when the pickup roller is in the banknote pickup position, and is operative to be separated from the one sensor in response to the pickup roller deviating from the banknote pickup position;

wherein the cash box further comprises a pressing plate arranged in the banknote storage chamber and configured for supporting the banknote, wherein the pressing plate is configured to move in a direction of nearing the guiding plate to successively drive the guiding plate to deviate from the banknote feeding position and drive the pickup roller to reach the banknote pickup position; and wherein the one sensor is disposed on a side of the guiding plate facing away from the pressing plate, and the first detecting member is located downstream of the second detecting member in a direction pointing from the pressing plate to the guiding plate.

8. The banknote processing device of claim 7, wherein the banknote storage chamber further comprises an entrance-and-exit; an end of the guiding plate adjacent to the entrance-and-exit is pivotally connected with a housing and is operative to rotate around an axis of a pivoting shaft, and the first detecting member is operative to rotate synchronously along with the guiding plate.

9. The banknote processing device of claim 7, wherein the cash box further comprises a support frame configured to support the pickup roller, wherein one end of the support frame is pivotally connected with a housing of the cash box and is operative to rotate around an axis of a pivoting shaft; the second detecting member is fixedly connected with the support frame, wherein the second detecting member and the pickup roller are both operative to rotate synchronously along with the support frame, the pickup roller having the banknote pickup position and an initial position in a rotating process.

10. The banknote processing device of claim 9, wherein the guiding plate and the support frame are coaxially pivotally connected with the housing and are both rotatable about the axis of the pivoting shaft, and the first detecting member is operative to rotate synchronously with the guiding plate.

11. The banknote processing device of claim 9, wherein the cash box further comprises an elastic component and a limiting member, wherein one end of the elastic component is connected with the housing, and another end of the elastic component is connected with the support frame; when at the initial position, the pickup roller is operative to abut against the limiting member, and the elastic component is configured to allow the pickup roller to have a permanent tendency of abutting against the limiting member.

12. The banknote processing device of claim 7, wherein the pickup roller is slidably connected with a housing of the cash box, two ends of a core shaft of the pickup roller are slidably disposed in a guide groove of the housing and are movable along a length of the guide groove, the pickup roller having an initial position and the banknote pickup position.

* * * * *